US005148639A

United States Patent [19]

Sakai et al.

[11] Patent Number: 5,148,639

[45] Date of Patent: Sep. 22, 1992

[54] SURFACE ROUGHENING METHOD FOR ORGANIC ELECTROPHOTOGRAPHIC PHOTOSENSITIVE MEMBER

[75] Inventors: Kiyoshi Sakai, Chofu; Teigo Sakakibara; Harumi Sakou, both of, Tokyo; Shoji Amamiya, Sagamihara, all of Japan

[73] Assignee: Canon Kabushiki Kaisha, Tokyo, Japan

[21] Appl. No.: 820,810

[22] Filed: Jan. 15, 1992

Related U.S. Application Data

[63] Continuation of Ser. No. 386,221, Jul. 28, 1989, abandoned.

[30] Foreign Application Priority Data

Jul. 29, 1988 [JP] Japan ..... 63-189820

[51] Int. Cl.[5] ..... B24B 21/00; G03G 21/00

[52] U.S. Cl. ..... 51/328; 51/142; 355/300

[58] Field of Search ..... 51/135 R, 137, 141, 51/142, 145 R, 147, 281 R, 328; 355/256, 272, 300

[56] References Cited

U.S. PATENT DOCUMENTS

| | | | |
|---|---|---|---|
| 3,354,588 | 11/1967 | Roehrig | 51/141 |
| 3,429,079 | 2/1969 | Winebarger | 51/141 |
| 3,888,050 | 6/1975 | Elm | 51/141 |
| 3,972,152 | 8/1976 | Faure | 51/141 |
| 4,329,043 | 5/1982 | Kuehnle | 355/272 |
| 4,364,329 | 12/1982 | Murai et al. | 51/295 |
| 4,407,918 | 10/1983 | Sato | 355/272 |
| 4,576,467 | 3/1986 | Yamasaki et al. | 355/256 |
| 4,587,192 | 5/1986 | Lind et al. | 355/256 |
| 4,720,939 | 1/1988 | Simpson et al. | 51/135 |
| 4,841,683 | 6/1989 | Williams | 51/142 |
| 4,866,480 | 9/1989 | Hosoya et al. | 355/261 |

FOREIGN PATENT DOCUMENTS

| | | | |
|---|---|---|---|
| 52-26226 | 2/1977 | Japan . | |
| 56-1973 | 1/1981 | Japan | 355/300 |
| 56-6286 | 1/1981 | Japan | 355/300 |
| 57-94771 | 12/1982 | Japan . | |
| 57-210383 | 12/1982 | Japan | 355/300 |
| 59-105671 | 6/1984 | Japan | 355/300 |
| 59-226370 | 12/1984 | Japan | 355/300 |
| 199060 | 4/1989 | Japan . | |

*Primary Examiner*—Bruce M. Kisliuk
*Assistant Examiner*—John A. Marlott
*Attorney, Agent, or Firm*—Fitzpatrick, Cella, Harper & Scinto

[57] ABSTRACT

In a method of roughening the surface of an organic electrophotographic photosensitive member by bringing an abrasive material into slidable contact with said surface, an abrasive material in the form of a film is moved in the direction intersecting the direction of a rotating shaft of said photosensitive member, with the vibration thereof at the part coming into slidable contact with said photosensitive member, thereby roughening the surface of said photosensitive member.

14 Claims, 2 Drawing Sheets

SURFACE ROUGHENING METHOD FOR ORGANIC ELECTROPHOTOGRAPHIC PHOTOSENSITIVE MEMBER

This application is a continuation of application Ser. No. 07/386,221 filed Jul. 28, 1989, now abandoned.

BACKGROUND OF THE INVENTION

1. Field of the Invention

The present invention relates to a surface roughening method for an organic electrophotographic photosensitive member. More particularly, it relates to a surface roughening method that forms the surface of an organic electrophotographic photosensitive member into a uniformly roughened surface in a short time.

2. Related Background Art

Electrophotographic photosensitive members, when used, are set into electrophotographic apparatus comprising at least the steps of electrostatic charging, imagewise exposure, development, transfer, and cleaning. In carrying out such an electrophotographic process, the step of cleaning to remove remaining toner after transfer is required in any developing processes.

Methods of carrying out this cleaning usually include the following two types. One of them is a method in which a rubber material called a blade is brought into pressure contact with a photosensitive member so that there may be no gap between the photosensitive member and blade and thus the toner can be prevented from slipping through the gap. The other of them is a method in which the roller of a fur brush is rotated in such a manner that the brush may come into contact with the surface of a photosensitive member to wipe off or brush off the toner. Of these, the latter method tends to allow the toner to slip through, unless the brush is brought into firm contact with the photosensitive member, or may scratch the photosensitive member if the toner having collected on the fur brush is fused. Moreover, the rubber blade is more inexpensive and can be designed with greater ease. For these reasons, cleaning using the blade is prevails at present. In particular, in carrying out the natural color developing that has been put into practical use in recent years, the toner is used in a much larger quantity than the ordinary single-color developing since the natural color is produced by overlapping the three primary colors of magenta, cyan and yellow, or four colors in which black is further included. Thus, it is most suited to use the cleaning method in which the rubber blade is brought into pressure contact with the photosensitive member.

In instances in which the cleaning of a wet toner is carried out using this cleaning blade, the wet toner itself and a solvent therefor, which are comprised of fine particles, come into the gap between the cleaning blade and photosensitive member surface to play a role as a lubricant, so that there has been no problem.

In instances in which the cleaning of a dry magnetic toner is carried out using this cleaning blade, however, this toner itself has such a good ability for abrading the photosensitive member surface that the surface of the photosensitive member can be readily roughened and hence the lubricity or slipperiness between the photosensitive member surface and cleaning blade can be improved. However, at the initial stage in using the photosensitive member, there is a large frictional force between the photosensitive member surface and blade because of a lack of roughness on the photosensitive member surface at that stage, sufficient to the cause the cleaning blade to reverse direction. Thus the surface must be coated with a lubricant.

In the case when a dry non-magnetic toner must be used with the introduction of color systems, the toner used therefor has a photosensitive member surface-abrasive power of only not more than one-tenth of that of the magnetic toner. Although iron powder or ferrite, or these materials coated with resins, used as a magnetic material (carrier), can brush the photosensitive member when developing is carried out, this dry two-component developing system can achieve a photosensitive member surface-abrasive powder of only about one-third of that of the dry one-component developing system. For this reason, when the dry non-magnetic toner is used, the friction between the photosensitive member surface and blade can not be sufficiently relieved, tending to cause the problems of blade reversing, edge breaking, or the like.

When the natural color developing is used, the problems which are seriously caused are such that the cleaning blade reverses, and the blade edges are torn off and broken. This is because natural color developing, which employs the dry two-component developing system, results in a poor photosensitive member surface-abrasive powder as shown above and, in addition thereto, because of the following reasons (1) and (2):

(1) Since the developing is carried out three or four times corresponding to the three primary colors of magenta, cyan and yellow, or the four colors including black, to produce a sheet of image, the processing is required to be carried out at a higher speed, resulting in an increase in the friction applied to the cleaning blade.

(2) Since the three or four color toners transferred to paper must be fixed so that they may be sufficiently melted and mixed, it is necessary to use toners with a low glass transition point (Tg), i.e., a Tg of not more than 60° C. that results in a toner having a high agglomeration and adhesion and weaken its function as a lubricant, which function is possessed by conventional toners that enter into the gap between the cleaning blade and photosensitive member surface to improve the lubricity.

The troubles of the cleaning blade reversing and edge breaking tend to more often occur when the photosensitive member surface is hard, i.e., made with little abrasiveness so that the photosensitive member can have a longer life time. Moreover, when the toner particle size is made uniform and fine toner is removed in order to improve image quality, the lubricity produced when the toner enters into the gap between the cleaning blade and photosensitive member surface is more diminished, tending all the more to cause the blade reversing or edge breaking.

In the instance in which a surface layer of the photosensitive member comprises an organic matter, the frictional resistance between the blade and photosensitive member surface may increase, particularly tending to cause blade turn-up or the like, when compared with a member having an inorganic surface.

To settle such problems, the present applicants have proposed to previously make the photosensitive member surface rough, as disclosed in Japanese Patent Laid-open No. 1-99060 corresponding to U.S. Ser. No. 253082 filed Oct. 4, 1988 now abandoned. This enables reduction of the contact area between the photosensitive member surface and cleaning blade, and also makes it possible to prevent the cleaning defects such as cleaning blade reversing, by virtue of the lubricity produced when the fine toner appropriately creeps into the gap between the photosensitive member surface and blade.

On the other hand, as a method of roughening the surface of a photosensitive member, a method is known in which powder particles are previously included in a surface layer of a photosensitive member by coating, to provide a roughened surface, as disclosed in Japanese Patent Laid-open No. 52-26226. In this method, however, it has been difficult to control the degree of surface roughness, and a uniform roughened surface has been obtainable with difficulty. Another method is known in which the resilience at tips of a metallic wire or fiber brush is utilized to abrade the surface of a photosensitive member, as disclosed in Japanese Patent Laid-open No. 57-94772. In this method, however, it has been difficult to carry out uniform surface-roughening in a short time, and scratches on the photosensitive member surface may be produced, tending to cause defective images.

SUMMARY OF THE INVENTION

An object of the present invention is to provide a surface roughening method capable of carrying out in a short time the surface roughening of a photosensitive member that is carried out to prevent cleaning defects caused by cleaning blade reversing, edge breaking, etc.

Another object of the present invention is to provide a surface roughening method that can obtain a photosensitive member, highly durable and free from any defective images even after its repeated use.

The present inventors made intensive studies to settle the above problems. As a result, they found that a specific surface roughening can bring about a superior roughened surface, thus having accomplished the present invention.

Stated summarily, the present invention provides a method of roughening the surface of an organic electrophotographic photosensitive member by bringing an abrasive material into slidable contact with said surface, wherein an abrasive material in the form of a film is moved in the direction intersecting the direction of a rotating shaft of said photosensitive member, with the vibration thereof at the part coming into slidable contact with said photosensitive member, thereby roughening the surface of said photosensitive member.

DETAILED DESCRIPTION OF THE PREFERRED EMBODIMENTS

The present invention will be specifically described below.

Figure 1:
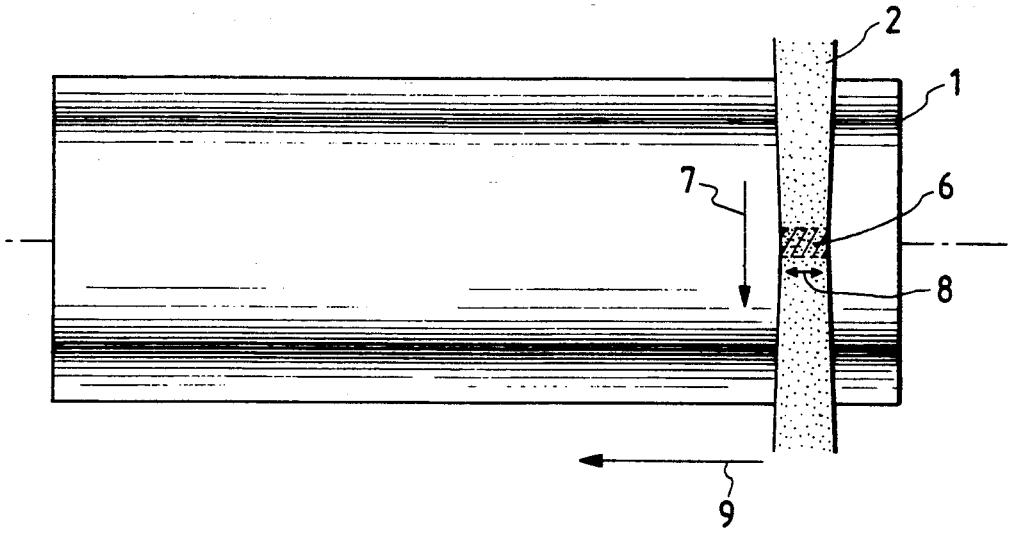
FIG. 1 is a schematic front elevation to illustrate the surface roughening method of the present invention.

FIG. 1 is an illustration wherein the part roughened by the surface roughening method of the present invention is viewed from the front. An abrasive material 2 in the form of a film is brought into slidable contact with an organic electrophotographic photosensitive member. This abrasive material 2 is moved in the direction, as shown by an arrow 7, intersecting the direction of a rotating shaft of the photosensitive member 1. The part 6 coming into slidable contact with the photosensitive member 1 is made to tremble in the direction shown by an arrow 8 (the direction parallel to the direction of the rotating shaft of the photosensitive member) to give fine vibration. In this instance, the abrasive material 2 may preferably be moved in the direction intersecting substantially at right angles the direction of the rotating shaft of the photosensitive member 1. The roughened surface can be sufficiently obtained even if the former is not at right angles to the latter. The vibration at the part 6 coming into the slidable contact may preferably be periodical in order to carry out uniform surface roughening, but can be non-periodical. The direction of the vibration may also be not only in the two directions shown by the arrow 8 but also in various direction.

With such a constitution of the present invention, finely powdery scrapings resulting from the abrasion of the photosensitive member by the abrasive material, act as a secondary fine abrasive material because of the vibration of the abrasive material, while they are appropriately kept at the part coming into the slidable contact. In addition, as the abrasive material is moved, an always new abrasive surface of the abrasive material comes into slidable contact with the photosensitive member to abrade it without a lowering of surface roughening efficiency because of, e.g., clogging.

As a result, the mutual action of the vibration and movement of the abrasive material enables the roughening of the photosensitive member surface to an appropriate roughness by which the cleaning defects can be prevented, and also enables the uniform roughening of the photosensitive member surface in a short time.

Figure 2:
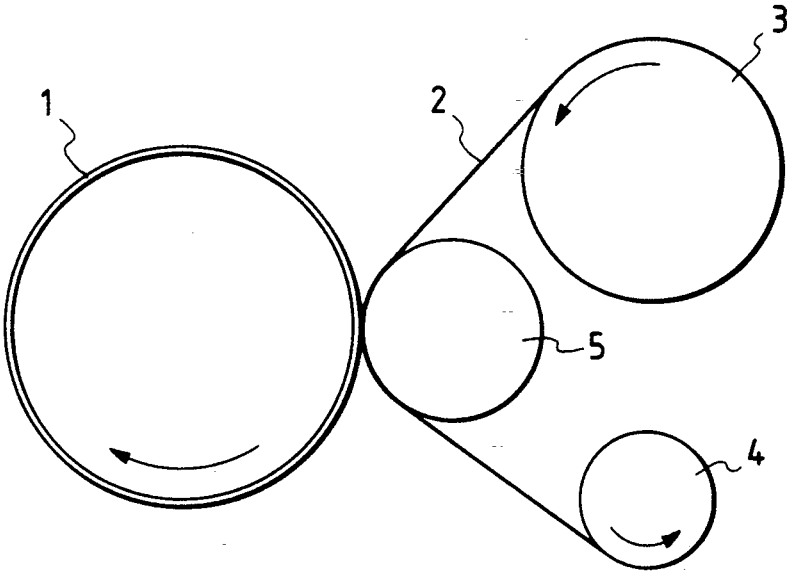
FIG. 2 is a schematic cross section of an apparatus for specifically working the surface roughening method of the present invention.
Figure 3:
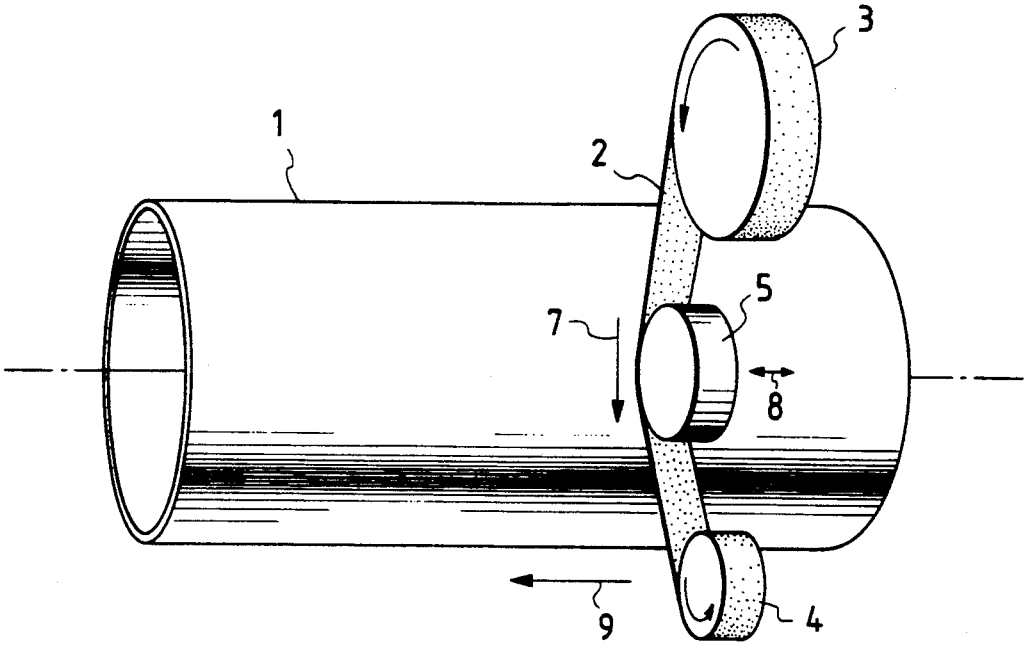
FIG. 3 is a diagramatical illustration wherein the apparatus is perspectively viewed.

FIG. 2 schematically illustrates a cross section of an embodiment of an apparatus for working the surface roughening method of the present invention on a cylindrical organic electrophotographic photosensitive member. FIG. 3 also diagramatically illustrates an instance in which this apparatus is perspectively viewed. The film-like abrasive material 2 is let off from a let-off roller 3 and wound up on a wind-up roller 4, and is moved at a constant speed. This film-like abrasive material is pressed by a rubber roller 5 positioned at opposite side to the organic electrophotographic photosensitive member 1, and thus brought into slidable contact with the photosensitive member. This rubber roller 5 is vibrated, so that the slidable contact part of the film-like abrasive material 2 is vibrated in the direction shown by the arrow 8. The cylindrical organic electrophotographic photosensitive member is rotated in the direction shown by the arrow. Under such condition, the film-like abrasive material 2 is further moved to the direction shown by an arrow 9, parallel to the direction of the rotating shaft of the photosensitive member, so that a uniform roughened surface can be easily formed over the whole surface area of the photosensitive member in a short time (as short as one-several tenth when compared with an abrasive material not vibrated). Alternatively, a film-like abrasive material with substantially the same width as the surface width of the photosensitive member to be subjected to the surface roughening may also be used, so that the photosensitive member surface can be roughened without the moving of the film-like abrasive material in the direction shown by the arrow 9. The film-like abrasive material may be moved at a variable speed. The vibration at the slidable contact part of the film-like abrasive material may originate from any of an electrical system and a mechanical (sound) system. The rubber roller that presses the film-like abrasive material against the photosensitive member may be comprised of a nonrotating pressing member. Even if, however, such a pressing member is not provided, the slidable contact can be attained. The organic electrophotographic photosensitive member 1 may also be rotated in the reverse direction. This apparatus may be used with its whole set sideways or with its whole set lengthways.

The film-like abrasive material used in the present invention comprises a support comprising a polymeric film made of polyester or the like, and abrasive particles provided on one side or both sides of the substrate by coating or bonding. The type of abrasive particles, film particle size, and width and thickness of the substrate can be appropriately selected.

The degree of surface roughening on the photosensitive member surface roughened by the surface roughening method of the present invention is expressed by the 10 point average surface roughness $R_z$ as defined in JIS B0601 (hereinafter merely "average surface roughness"), and may preferably range from 0.3 μm to 5.0 μm, and more preferably from 0.3 μm to 2.0 μm. An average surface roughness made larger than 5.0 μm may cause, as an defective image, the appearance of stripes or the like in an image, when the photosensitive member surface is further roughened as a result of repeated use. Even the average surface roughness of from 2.0 μm to 5.0 μm may sometimes also cause, as a defective image, the appearance of stripes or the like in an image, if the photosensitive member is repeatedly used in an environment and under conditions which are in a poor state. The average surface roughness of not more than 2.0 μm can achieve a sufficiently small friction between the cleaning blade and photosensitive member surface, and also may not cause any appearance of the defective image even after repeated use.

An average surface roughness smaller than 0.3 μm may result in little relief of the friction between the cleaning blade and photosensitive member surface, and may make it difficult for the powdery scrapings to be produced on the photosensitive member surface because of the flatness of the photosensitive member surface, bringing about no effect of providing the roughened surface. The average surface roughness of not less than 0.3 μm, however, enables sufficient relief of the friction between the cleaning blade and photosensitive member surface, making it ready for the powdery scrapings to be produced on the photosensitive member surface, and hence may not cause any problems of blade reversing and so forth. Thus, the average surface roughness of from 0.3 μm to 5.0 μm, on the photosensitive member surface can prevent the cleaning defects such as cleaning blade reversing and blade edges breaking.

Figure 4:
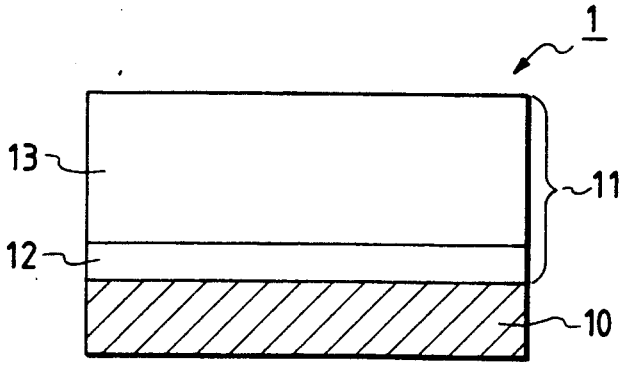
FIG. 4 is a diagramatical cross section of an organic electrophotographic photosensitive member.

The organic electrophotographic photosensitive member used in the present invention comprises a conductive support 10 and a photosensitive layer 11 provided thereon (FIG. 4), and at least the surface of the photosensitive member is formed of a resin layer. The powdery scrapings of the resin scraped as a result of the surface roughening are so fine and have so appropriate hardness that they can effectively act on the process of roughening the surface of the photosensitive member, in the surface roughening method of the present invention. From this viewpoint, the resin layer on the surface may preferably be mainly comprised of polycarbonate resin.

The photosensitive layer 11 may preferably be a laminated type photosensitive layer which is functionally separated into a charge generation layer 12 and a charge transport layer 13.

The charge generation layer can be formed by incorporating a charge-generating material such as a phthalocyanine pigment, a quinone pigment, an azo pigment, a pyranthrone pigment or an anthanthrone pigment, by dispersion in a suitable binder resin. In instances in which the charge generation layer is provided beneath the charge transport layer, the charge generation layer can also be formed as a deposited film, using a vacuum deposition apparatus. The film thickness thereof may preferably range from 0.01 to 3 μm, and particularly from 0.05 to 1 μm.

The charge transport layer can be formed by incorporating a charge-transporting material such as a hydrazone compound, a pyrazoline compound, a styryl compound or an oxazole compound in a suitable binder resin. The film thickness thereof may preferably range from 10 to 30 μm, and particularly from 15 to 25 μm. The charge transport layer may preferably be provided on the charge generation layer.

In instances in which the photosensitive layer is of a single layer type, it can be formed by simultaneously incorporating the charge-generating material and charge-transporting material in a suitable binder resin. The film thickness thereof may preferably range from 10 to 50 μm, and particularly from 15 to 30 μm.

The binder resin includes polycarbonate resins, polyester resins, acrylic resins, polyvinyl butyral resins, polystyrene resins, and ethyl cellulose resins.

The conductive support that can be used may be made of a metal such as aluminum, an aluminum alloy, and stainless steel, a plastic or paper applied with conductive treatment, or the above metal provided with a conductive layer.

A protective layer comprised of a resin may also be provided on the photosensitive layer so that the deterioration due to ultraviolet rays or ozone, or the scratching due to the slidable contact can be prevented. The film thickness thereof may preferably range from 0.1 to 10 μm, and particularly from 1 to 5 μm.

A subbing layer may also be provided between the conductive support and photosensitive layer so that barrier properties or adhesion can be improved.

According to the surface roughening method for the organic electrophotographic photosensitive member, of the present invention, it is possible to form a uniform and fine roughened surface, free from any cleaning defects such as cleaning blade reversing and so forth.

EXAMPLES

The present invention will be further described below by giving Examples.

EXAMPLE 1

Using as a support an aluminum cylinder of 80 mm in diameter and 360 mm in length, a 5% methanol solution of a soluble nylon (a 6-66-610-12 four-component nylon copolymer) was applied thereon by dip coating to provide a subbing layer of 1 μm thick.

Next, 10 parts (parts by weight; the same applies hereinafter) of a disazo pigment having the following structural formula:

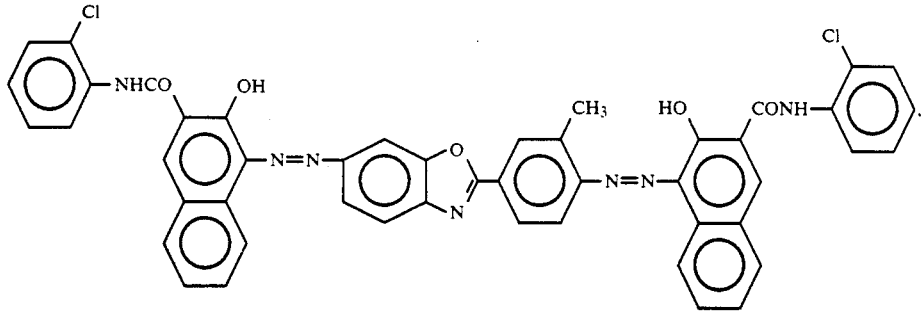

5 parts of polyvinyl butyral (degree of butylarization: 68%; number average molecular weight: 20,000) and 50 parts of cyclohexanone were dispersed for 20 hours in a sand mill using glass beads of 1 mm in diameter. In the resulting dispersion, 90 parts of methyl ethyl ketone was added, and the resulting solution was applied on the subbing layer to form a charge generation layer with a film thickness of 0.1 μm.

Next, 10 parts of bisphenol Z polycarbonate (viscosity average molecular weight: 30,000) and 10 parts of a hydrazone compound having the following structural formula:

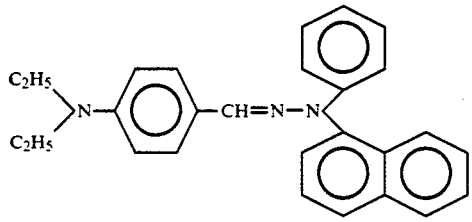

were dispersed in 65 parts of monochlorobenzene. The resulting solution was applied on the above charge generation layer by dip coating to form a charge transport layer with a thickness of 19 μm. In this manner, prepared were 9 organic electrophotographic photosensitive members. These photosensitive members all had a average surface roughness of 0 μm.

Next, a film-like abrasive material comprising a polyester film substrate, coated thereon with diamond abrasive particles and having a film particle size of 6 μm, a thickness of 50 μm, a width of 50 mm and a length of 91 m (Wrapping Film #2500; a product of Sumitomo 3M Limited.) was set on the let-off roller 3 and the wind-up roller 4 of the same surface roughening apparatus as the apparatus of FIG. 2. In this apparatus, the film-like abrasive material 1 is so designed as to be moved in the direction of the arrow 7 at a speed of 20 mm per 1 minute. The film-like abrasive material at the part coming into the slidable contact is also so designed as to be vibrated with a frequency of 9 Hz and a width of 5 mm in the direction shown by the arrow 8, by the vibration of the rubber roller 5.

Using this surface roughening apparatus, the above organic electrophotographic photosensitive member was rotated at a speed of 220 r.p.m., and its surface was roughened in the area with a width of 320 mm in the direction of the rotating shaft of the photosensitive member so as to give an average surface roughness (Rz) of 1.0 μm and a maximum surface roughness of 1.5 μm. As a result, it was possible to roughen the surface in 23 seconds.

Next, a developer was prepared according to the following procedures.

After 100 parts of a polyester resin, 2 parts of a charge-controlling agent (a chromium complex of a dialkylsalicylic acid), 3 parts of a release agent (a low molecular polyolefin) and 4 parts of C.I. Solvent Red 52 as a coloring agent were pre-mixed, the mixture was melt kneaded in an extruder, and then cooled. Thereafter the kneaded product thus cooled was finely ground using a jet mill grinder, followed by classification to obtain a magenta non-magnetic toner with an average particle diameter of 12.0 μm. This non-magnetic toner (6 parts) were mixed with 100 parts of a carrier comprising magnetic ferrite powder resin-coated with a vinylidene fluoride/tetrafluoroethylene copolymer and a styrene/methyl methacrylate copolymer, to prepare a two component developer.

Using this developer and also using the surface-roughened organic electrophotographic photosensitive member previously described, these were set in an electrophotographic apparatus having the steps of electrostatic charging, imagewise exposure, development, transfer, and cleaning (line pressure: 11.5 g/cm) using a polyurethane rubber blade, and then images were repeatedly produced for evaluation. As a result, there occurred no cleaning defects such as cleaning blade reversing, and also the copy images were visually carefully observed. No defective image ascribable to the surface roughening was seen. Good copy images were obtained to the extent of 100,000 sheets.

COMPARATIVE EXAMPLE 1

In the surface roughening apparatus used in Example 1, the organic electrophotographic photosensitive member like the one previously described, whose surface has not been roughened, was subjected to surface roughening only with application of vibration to the film-like abrasive material, without the moving of that abrasive material. As a result, the film-like abrasive material turned clogged in 5 minutes after the surface roughening was started, accompanied after that with an extreme lowering of the effect of surface roughening, which made it impossible to carry out the surface roughening. The surface-roughened part of the resulting photosensitive member showed an average surface roughness (Rz) of 0.3 μm and also a maximum surface roughness of 0.6 μm. This photosensitive member was set into the electrophotographic apparatus in Example 1, and it was tried to make an image evaluation, but, as a result, the cleaning blade reversed with the rotation of the photosensitive member and the photosensitive member became unrotatable.

COMPARATIVE EXAMPLE 2

In the surface roughening apparatus used in Example 1, the organic electrophotographic photosensitive member like the one previously described, whose surface has not been roughened, was subjected to surface roughening only with the moving of the film-like abrasive material without application of vibration to that abrasive material, so as to give an average surface roughness (Rz) of 1.0 μm and a maximum surface roughness of 1.5 μm similarly to the case of Example 1. As a result, it took 8 minutes for the surface roughening. This photosensitive member was also set into the electrophotographic apparatus in Example 1 to make image evalution. As a result, slightly thin stripes in the direction of the rotation of the photosensitive member were observed on the copy images obtained at the initial stage, but, except this, copy images with no problem were obtained to the extent of 100,000 sheet duration.

EXAMPLES 2 TO 4

Using the surface roughening apparatus under the same conditions as Example 1 except that the abrasive particles of the film-like abrasive material used in Example 1 was replaced with aluminum oxide particles, the film particle size was changed to 5 μm, 9 μm or 12 μm, the vibration width of the abrasive material was changed to 4 mm, and the movement speed of the abrasive material was changed to 30 mm/min, the organic electrophotographic photosensitive members like the one previously described, whose surfaces have not been roughened, were subjected to surface roughening. Results obtained are shown in Table 1. These organic eletrophotographic photosensitive members having been subjected to the surface roughening were each set into the electrophotographic apparatus used in Example 1 to make evaluation on copy images. Results obtained are also shown in Table 1.

TABLE 1

| Example: | 2 | 3 | 4 |
|---|---|---|---|
| Film particle size: | 5 μm | 9 μm | 12 μm |
| Average surface roughness: | 0.9 μm | 1.2 μm | 1.3 μm |
| Maximum surface roughness: | 1.2 μm | 1.9 μm | 2.1 μm |
| Surface-roughening time: | 35 sec | 18 sec | 14 sec |
| Image evaluation: | A | A | A |

A: Good images were obtained to the extent of 100,000 sheets

COMPARATIVE EXAMPLES 3 TO 5

Under surface roughening conditions in Example 2, the organic electrophotographic photosensitive member like the one previously described, whose surface has not been roughened, was subjected to surface roughening only with application of vibration to the film-like abrasive material, without the moving of that abrasive material. This is designated as Comparative Example 3. Under surface roughening conditions in Examples 3 and 4, the organic electrophotographic photosensitive members like the one previously described, whose surfaces have not been roughened, were subjected to surface roughening only with the moving of the film-like abrasive material, without application of vibration to that abrasive material. These are designated as Comparative Examples 4 and 5. Results obtained on these are shown in Table 2. These organic electrophotographic photosensitive members having been subjected to the surface roughening were each set into the electrophotographic apparatus used in Example 1 to make evaluation on copy images. Results obtained are also shown in Table 2.

TABLE 2

| Comparative Example: | 3 | 4 | 5 |
|---|---|---|---|
| Film particle size: | 5 μm | 9 μm | 12 μm |
| Average surface roughness: | 0.2 μm | 1.1 μm | 1.1 μm |
| Maximum surface roughness: | 0.4 μm | 1.9 μm | 2.0 μm |
| Surface-roughening time: | 8 sec* | 8 min | 7 min |
| Image evaluation: | C | B | B |

B: Slightly thin stripes were observed at the initial stage, but, after that, good copy images were obtained up to 100,000 sheets.
C: Image production became impossible because of the cleaning blade reversing having occurred at the initial stage.
*In Comparative Example 3, however, the abrasive material turned clogged in a surface roughening time of 8 second, and after that it became impossible to carry out the surface roughening.

As will be evident from the above results, the surface roughening method of the present invention can shorten the surface roughening time by the factor of one-several tenth, and enables formation of a uniform roughened surface.

We claim:

1. A method of roughening the rotating surface of an organic electrophotographic photosensitive member capable of visualizing toner images on said surface to reduce friction between said surface and a cleaning blade employed to remove excess toner from said surface which comprises:
   (a) contacting an abrasive material with said rotating surface, wherein said abrasive material is in the form of a film, while rotating said film in the same direction of said rotating surface;
   (b) vibrating said film at the point of said contact with said rotating surface in a vibrating direction parallel to the axis of rotation of said photosensitive member; and
   (c) urging said rotating and vibrating film against said rotating surface in a direction substantially perpendicular to the axis of rotation of said photosensitive member.

2. In an image forming method comprising the steps of
   (i) charging an organic electrophotographic photosensitive member;
   (ii) forming an electrostatic latent image on the surface of said photosensitive member by imagewise exposure;
   (iii) developing the formed electrostatic latent image;
   (iv) transferring the developed image; and
   (v) cleaning the surface of the photosensitive member with a blade after the developed image is transferred; the improvement which comprises:
   roughening the surface of said organic electrophotographic photosensitive member prior to conducting said charging step (i) by the steps of:
   (a) contacting an abrasive material with said surface at a point of contact, said abrasive material in the film-like form being urged in the direction intersecting the direction of the axis of rotation of said surface of said photosensitive member; and
   (b) vibrating said film like abrasive material at the point of said contact with the surface of said photosensitive member.

3. An image forming method according to claim 2, wherein said film-like abrasive material is moved in the direction intersecting substantially at right angles the direction of the axis of rotation of the photosensitive member.

4. An image forming method according to claim 2, wherein said film-like abrasive material is vibrated at said point of contact, in the direction parallel to the direction of the axis of rotation of the photosensitive member.

5. An image forming method according to claim 2, wherein said film-like abrasive material at said point of contact is vibrated in multiple directions.

6. An image forming method according to claim 2, wherein said film-like abrasive material at said point of contact is vibrated periodically.

7. An image forming method according to claim 2, wherein said film-like abrasive material moved with the vibration at said point of contact is further moved in the direction parallel to the direction of the axis of the rotation of the photosensitive member.

8. An image forming method according to claim 2, wherein said film-like abrasive material is let off from a let-off roller and wound up on a wind-up roller.

9. An image forming method according to claim 2, wherein said film-like abrasive material is moved at a constant speed.

10. An image forming method according to claim 2, wherein said film-like abrasive material is pressed against the photosensitive member by means of a rubber roller.

11. An image forming method according to claim 10, wherein said film-like abrasive material is vibrated by vibration of the rubber roller.

12. An image forming method according to claim 2, wherein the degree of roughness on the surface of the photosensitive member ranges from 0.3 μm to 5.0 μm.

13. An image forming method according to claim 2, wherein said photosensitive member has a surface comprised of a resin layer.

14. An image forming method according to claim 13, wherein said resin layer is mainly comprised of a polycarbonate resin.

* * * * *